United States Patent [19]

Walther

[11] Patent Number: 4,572,176

[45] Date of Patent: Feb. 25, 1986

[54] CONTROL FOR A PROTECTIVE MASK WHICH OPERATES WITH EXCESS INTERNAL PRESSURE

[75] Inventor: Hans-Joachim Walther, Lubeck, Fed. Rep. of Germany

[73] Assignee: Drägerwerk Aktiengesellschaft, Fed. Rep. of Germany

[21] Appl. No.: 543,317

[22] Filed: Oct. 19, 1983

[30] Foreign Application Priority Data

Dec. 10, 1982 [DE] Fed. Rep. of Germany ..... 3245717

[51] Int. Cl.[4] ..... A62B 7/04

[52] U.S. Cl. ..... 128/204.26; 137/908 137/DIG. 9

[58] Field of Search ..... 128/204.26, 204.27, 128/205.24; 137/495, 505.14, 505.46, 505.47, DIG. 9

[56] References Cited

U.S. PATENT DOCUMENTS

| | | | |
|---|---|---|---|
| 986,344 | 3/1911 | Baehr | 137/505.46 |
| 1,824,072 | 9/1931 | Bullard | 137/495 |
| 2,406,888 | 9/1946 | Meidenbauer, Jr. | 128/204.26 |
| 3,180,356 | 4/1965 | Galley | 137/495 |
| 4,334,532 | 6/1982 | Jackson | 128/204.26 |

FOREIGN PATENT DOCUMENTS

| | | | |
|---|---|---|---|
| 268200 | 4/1970 | U.S.S.R. | 128/204.26 |

*Primary Examiner*—Henry J. Recla

*Attorney, Agent, or Firm*—McGlew and Tuttle

[57] ABSTRACT

Protective repiratory masks with excess pressure make sure that an excess pressure is maintained during both the inhalation and exhalation, whereby a penetration into the mask of the ambient atmosphere is prevented. A lung demand valve or control for the mask is divided by a control diaphragm into a respiratory chamber, and an outer chamber. The respiratory chamber communicates with, and follows the pressure in, the interior of the mask; to admit breathing gas, the respiratory chamber is connectable to the source through an inlet valve which is controlled by the control diaphragm through a lever and a rod. The outer chamber accommodates a locking mechanism which is manually actuable through a slide and by which the control diaphragm may be held in a pressure-relieved locked position in which also the inlet valve is closed. During periods where the mask is not in use, unnecessary supply of respiratory gas is interrupted. As soon as the mask is put on, the control diaphragm is released from its locked position by the started respiration alone, without any other manipulation on the part of the user, thus making possible a normal lung demand respiration with maintained excess pressure in the interior of the mask.

5 Claims, 3 Drawing Figures

CONTROL FOR A PROTECTIVE MASK WHICH OPERATES WITH EXCESS INTERNAL PRESSURE

FIELD AND BACKGROUND OF THE INVENTION

The invention relates in general to respiratory protective masks and in particular to a new and useful control for a protective mask.

Respiratory apparatus with excess pressure in the interior of the mask make sure that a higher pressure relative to the ambience is maintained in the mask during both the exhalation and the inhalation. This excess pressure prevents the ambient atmosphere which might be noxious from penetrating into the mask in use. Even with a leak, the gas flows from the inside outwardly. However, in masks of this kind, difficulties are met in that after use, upon removing the mask and thus opening the respiratory circuit, the breathing gas supply must be stopped or the function of the lung demand valve reversed, since otherwise breathing gas flows out unused and the service time of the apparatus is reduced.

A prior art respiratory mask is equipped with a lung demand valve producing and maintaining an excess pressure in the interior of the mask. The housing of this valve accommodates a respiratory chamber to be placed in front of the user's respiratory ducts and an outer chamber communicating with the outer atmosphere, and a pressure chamber therebetween which is connected to each of the adjacent chambers by a valve. This pressure chamber produces an excess pressure in the respiratory chamber, and thus in the interior of the mask, during both the inhalation and the exhalation. For this purpose one wall of the pressure chamber is movably connected to the inner wall of the valve housing through a control diaphragm. An actuating chamber caused by the respiration to a respiratory gas inlet valve of the mask.

A reversible locking mechanism makes it possible to interrupt the respiratory gas supply upon removing the mask. The locking mechanism includes a shaft which is mounted for rotation in the respiratory chamber. One end extends in an airtight bushing through the wall of the respiratory chamber to the outside where it is provided with a radial actuating lever permitting the pivoting of the shaft between two end positions. In one of the end positions, the locking position, a resilient lug of the actuating lever engages a recess in the wall of the respiratory chamber. In the interior, the shaft carries a wire strap. In the locking position, the wire strap engages the lever arm of the inlet valve and holds the valve in its closed position. A spring clip urges the wire strap, which is pivotable along with the shaft, into the other end position, the release position, in which the strap applies against the inside of the respiratory chamber and does not obstruct the free movement of the lever arm. With the mask removed, the actuating lever is engaged in its locking position whereby the breathing gas supply is interrupted. Upon putting the mask on, the first inhalation starts an automatic operation. During this operation, the suction acting on the diaphragm during the inhalation must produce a force acting on the lever arm and being sufficient for disengaging the locking mechanism. The spring clip brings the locking mechanism into the release position (German OS No. 30 38 100).

Since the force determining the setting in operation depends on engaging elements of the locking mechanism provided at the outside, the respective resistance of the elements to engagement and thus the reliability of the mechanism may be affected in the course of time by soiling, mechanical damages, or wear. The airtight bushing in the wall of the respiratory chamber is expensive and potentially a source of trouble, and so are the many individual parts of which the locking mechanism is assembled.

Another prior art lung demand respiratory apparatus, operated with compressed air and providing an excess pressure in the protective mask comprises a control diaphragm in the lung demand, and a metering valve to be opened by a preliminary pressure. The control diaphragm is exposed to the pressure of the ambient air and bounds a control space in the interior which is under the pressure of the interior of the mask. The control diaphragm is connected through a rocker arm to the metering valve to close it against the action of the inflowing compressed air as soon as a certain excess pressure is reached in the control space. A lengthwise movable spacer pin is tightly passed from the control space to the outside through the wall opposite the control diaphragm. The pin applies in the control space against a stop plate which is spring loaded in the direction of the control diaphragm. On its outer end, the spacer pin carries a rotatable reversing lever having the shape of an eccentric and bearing against the wall of the control space. In its position with the eccentric released, which is the locking position, the stop plate applies against the locker arm. The force of the compression spring then closes the metering valve even if the protective mask is removed and thus no excess pressure is present in the control space. In the position with the eccentric tensioned, which is the release position, the stop plate is held spaced from the locker arm and the control diaphragm is free to move. The reversal to the release position is automatic and occurs as soon as under the first breath the control diaphragm of the rocker arm displaces the spacer pin against the spring action outwardly. The reversal lever which is thereby unloaded is so oriented relative to the gravity that it tips into the release position under the weight of its handle. The reversal into the locking position is effected manually (German OS No. 26 20 170).

A precondition for the automatic release is that at that instant, the user remains in a position ensuring the provided orientation relative to the gravitational direction. Otherwise this reversal must also be effected manually. The necessary sealing of the space pin in the wall of the control space is expensive and susceptible to disturbances.

Still another prior art pressure gas protective apparatus provides an excess pressure in the mask which is connected through a lung demand valve and a line to the outlet of a pressure reducer wherefrom it is supplied with breathing gas.

Within the lung demand valve, a control diaphragm is exposed on its outside to the ambient pressure and loaded by a spring. The inside is loaded by the pressure in the interior of the mask. Against this side, one arm of a pivoted rocker arm is applied, while the other arm thereof is connected to the closing member of the valve, namely a piston. The closing piston is provided with a transverse aperture through which, in a respective position, the breathing gas line is either connected to the interior of the mask, or shut off. The following operating positions may be considered:

1. In standby position, with the mask removed, the interior of the mask is under the ambient pressure. The spring on the diaphragm is relieved and displaces through the rocker arm the closing piston into an end position thereby closing the breating gas line.

2. With the mask put on, upon an exhalation, an excess pressure is built up. Through the diaphragm, which bears against the spring, and through the rocker arm, the closing piston is displaced into the open position. Breathing gas flows into the mask. Upon reaching the desired excess pressure in the interior, the closing piston is displaced into the other end position and again interrupts the breathing gas supply.

3. During the further inhalation, the excess pressure is reduced; the desired excess pressure is maintained by a subsequent control of the closing piston.

4. Upon removing the mask, the excess pressure dissipates. The motion of the diaphragm displaces the closing piston into the other end position, the breathing gas flow is interrupted and the standby position as under 1 is reached again (German Pat. No. 30 15 760).

This prior apparatus with an excess pressure in the protective mask is suitable for being used under normal conditions. Conditions which require sudden greater amounts of breathing gas supply or even involve dynamic stresses, for example due to a run or jumps, cause jerky movements of the closing piston and thus uncontrolled respiratory conditions in the interior of the mask.

SUMMARY OF THE INVENTION

The invention is directed to equipping protective masks, which are used with pressure-gas respiratory apparatus and in which the excess pressure is to be maintained, with a lung demand ensuring the needed higher breathing gas supply even in instances where the user is exposed to varying physical load conditions, such as to sudden laborious efforts, and with which an outflow of breathing gas through an open valve of a breathing gas supply receptacle is prevented when the mask is not pun on, and yet the protective respiratory apparatus is instantly operative upon putting the mask on.

In accordance with the invention a protective respiratory mask which operates with excess pressure inside the mask includes a control device with the housing containing a movable diaphragm which moves against a lever to open and close a valve from a breathing gas connection leading to the mask. The movement of the diaphragm actuates an inlet valve for the breathing gas. The valve housing includes an outer chamber on the other side of the diaphragm from the valve which accommodates the locking mechanism having a pressure lever which is biased by a spring so that an arm portion of the lever rests against the control diaphragm. The lever includes a projecting portion forming a locking projection which is biased by a spring to maintain the arm on the control diaphragm. The diaphragm is provided with an annular upstanding collar in the outer chamber which is engaged and held by a locking slide which may be moved against a portion of the collar to hold the diaphragm so that the inlet valve remains closed.

Accordingly, it is an object of the invention to provide an improved control device which includes a flexible diaphragm for operating an inlet valve for breathing gas to a mask which has a locking device for locking the diaphragm and holding it in position so that the inlet valve may remain closed when the mask is not being used.

The invention has the particular advantage that only a few mechanically well resistant component parts are assembled in a way such that the lung demand valve which is controlled through the control diaphragm and loaded by a closing spring, remains in the controlled position, even under shocks, for example. A further special advantage is that the locking mechanism which is mounted outside the gastight parts, namely in the outer chamber, does not need any wall penetrations endangering the tightness.

A further object of the invention is to provide a control device for a breathing mask which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its use, reference is made to the accompanying drawings and descriptive matter in which preferred embodiments of the invention are illustrated.

DESCRIPTION OF THE PREFERRED EMBODIMENTS

Figure 1:
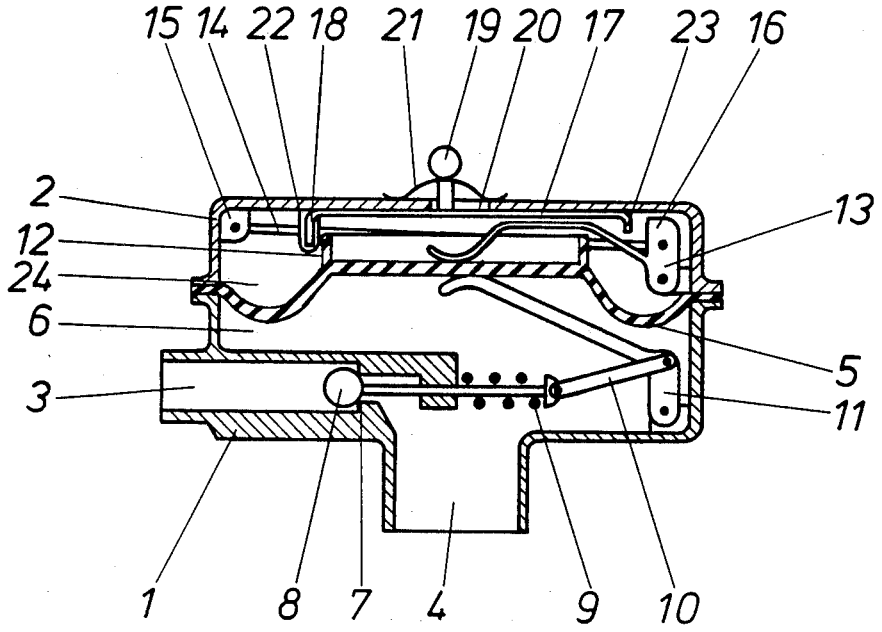
FIG. 1 is a sectional view of a lung demand valve constructed in accordance with the invention shown in a closed position.
Figure 2:
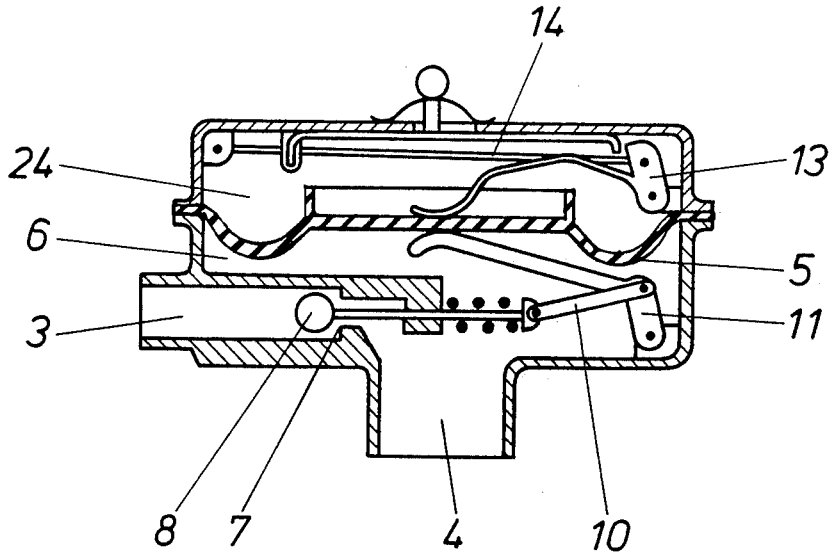
FIG. 2 is a view similar to FIG. 1 showing the valve in an open gas supplying position.

Referring to the drawings in particular the invention embodied therein comprises a control for a protective mask which includes a lung demand valve housing 1 which has a breathing gas connection for inlet 3 which may flow out through an outlet 4 in accordance with whether a valve body 8 is seated on a valve seat 7 as shown in FIG. 1 or as in an open position as shown in FIG. 2. In accordance with the invention a locking device including a slide 17 with a locking nose 18 is provided for holding a control diaphragm which divides the housing 1 into an outer chamber 24 and a respiration chamber 6. The control diaphragm 5 includes for this purpose a raised portion or annular collar 12 which is engaged and held by a locking nose 18 of slide 17 which locks the collar in position against a stop 22 arranged on the interior wall of the cover 2.

Figure 3:
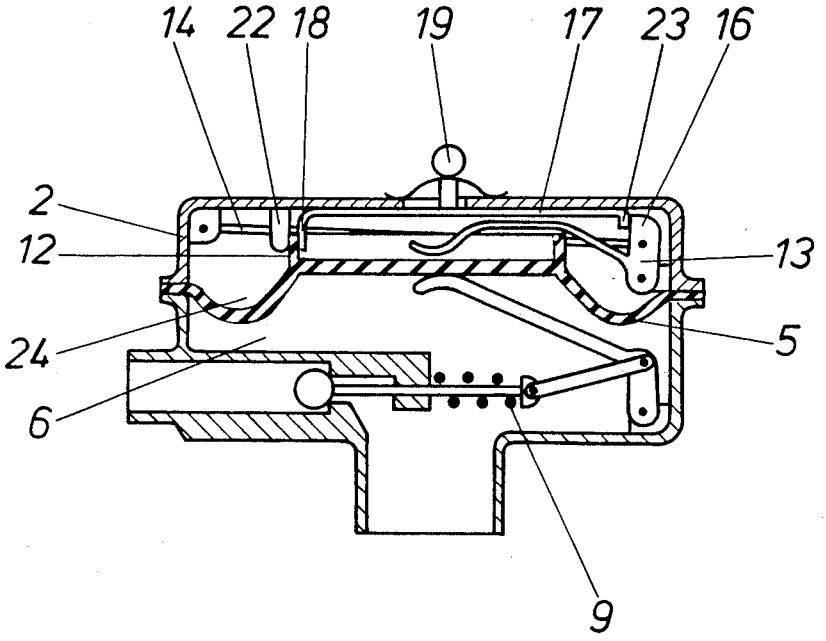
FIG. 3 is a view similar to FIG. 1 showing the valve in a locked position.

The following operating conditions shown in FIGS. 1 to 3 are to be distinguished:

A. According to FIG. 1, the lung demand valve comprises a housing 1 with a breathing gas connection 3 for the gas flowing in, an outlet connection 4 toward the protective mask, and a cover 2. The housing space at cover 2 is separated within housing 1 by a control diaphragm 5, so that an outer chamber 24 is formed above, at cover 2, and a respiratory chamber 6 is formed below, at the mask side, where the pressure is identical with that in the interior of the protective mask. Connection 3 is separated from respiratory chamber 6 by a lung demand inlet valve 7 for the breathing gas, comprising a valve seat 7 and a valve body 8. Valve body 8 is loaded in the closing direction by a closing spring 9, and is in operative contact with control diaphragm 5 through an actuating mechanism. In this mechanism, a link 10 is connected to a control lever 11 near the location where the lever is pivoted in housing 1, while the end of lever 11 applies against control diaphragm 5.

Control diaphragm 5 carries on its outside a cup-shaped retaining collar 12. Applied against this collar 12 is a long arm of a one-armed pressure lever 13. The lever is pivoted to cover 2 and has a short portion which is loaded by a semi-circular spring 14 in the direction of control diaphragm 5. At the opposite side, spring 14 is mounted on cover 2 in a bearing 15.

Pressure lever 13 is designed with a locking projection 16. This projection cooperates with the pushing end 23 of a locking slide 17 which is disposed within cover 2 where it is shiftable in its longitudinal direction, and has a locking nose 18 on its other end. Locking slide 18 is movable from the outside by means of a handle 19 which extends through a slot 20 in the cover. A check spring 21 ensures a smooth shifting. Two stops 22 are supported on the cover, one at either side of locking nose 18, yet both outside of the retaining collar 12.

In the closing position shown in FIG. 1, an excess pressure is present in the protective mask and thus also in respiratory chamber 6, by which control diaphragm 5 is lifted to apply against pressure lever 13 which is loaded in the opposite direction by spring 14. Closing spring 9 at the same time urges control lever 11 through link 10 into contact with control diaphragm 5, and also closes inlet valve 7, 8. The supply of breathing gas is interrupted.

B. According to FIG. 2; upon an inhalation, the pressure in the respiratory mask and in respiratory chamber 6 is reduced. Pressure lever 13 under the action of spring 14 therefore displaces control diaphragm 5, control lever 11 and link 10 to shift valve body 8 into open position. The breathing gas then flows into the mask. At the end of the inhalation, a higher, excess pressure builds up again in the mask due to the supply of breathing gas, by which control diaphragm 5 and the respective parts are returned to the position according to FIG. 1, so that inlet valve 7,8 closes.

C. According to FIG. 3, if it is wanted, upon removing the mask, to make sure that no breathing gas escapes in an uncontrolled manner, even though no excess pressure is present in respiratory chamber 6, inlet valve 7, 8 must remain closed. Therefore, a locking position is provided, in which the inlet valve again is closed. To this end, locking slide 17 is manually shifted by its handle 19 to the right. Its pushing end 23 lifts locking projection 16 and thereby pressure lever 13 against the action of spring 14, and thus relieves control diaphragm 5. The diaphragm moves upwardly under the action of the closing spring 9 since the pressure of lever 13 is removed. At the same time, retaining collar 12 penetrates into the space between stops 22 of cover 2 and locking nose 18 of locking slide 17. Upon releasing handle 19, locking slide 17 is somewhat moved back toward its initial position under the action of spring 14 and through projection 16, and clamps retaining collar 12 firmly in the gap. This locking position is then maintained without any further manipulation. Inlet valve 7, 8 has already closed as control diaphragm 5 was moved upwardly.

To start the operation again from the locking position, it suffices, upon putting on the mask, to deeply inhale. This inhalation moves the control diaphragm 5 in the direction of respiratory chamber 6 and thus pulls retaining collar 12 out of the gap. This immediately reestablishes the supply position according to FIG. 2, since simultaneously, inlet valve 7,8 opens and locking projection 16 shifts locking slide 17 completely back into the initial position. In further operation, again the supply and closing positions according to FIGS. 1 and 2 alternate.

While specific embodiments of the invention have been shown and described in detail to illustrate the application of the principles of the invention, it will be understood that the invention may be embodied otherwise without departing from such principles.

What is claimed is:

1. A control for a protective mask which operates with excess pressure inside the mask, comprising a housing having a hollow interior, a control diaphragm extending across the hollow interior of said housing and dividing said housing into an outer chamber and a breathing chamber, a gas inlet extending into said breathing chamber for supplying breathing gas, a gas outlet extending from said breathing chamber to the exterior for delivering the breathing gas to the mask, a valve between said inlet and outlet, first spring means urging said valve to a closed position, a control lever pivotally mounted in said breathing chamber and having a control lever arm portion engageable with said control diaphragm and movable therewith and being connected to said valve for moving said valve against the force of said first spring means between open and closed positions in accordance with the movement of said control diaphragm, a pressure lever pivotally mounted in said outer chamber having an extending locking projection and a pressure lever arm portion which engages on said control diaphragm on the opposite side thereof from said lever, second spring means mounted in said outer chamber and bearing against said projection and thereby pivoting said pressure lever arm portion into contact with said diaphragm to apply a counteracting force to the diaphragm against the force of said first spring means, and a locking member movably mounted on said housing and extending into the outer chamber and engageable with said locking projection to pivot said lever arm portion out of engagement with said diaphragm thereby permitting said diaphragm to move to a position in which said control lever permits said first spring means to urge said valve to a closed position.

2. A control for a protective mask according to claim 1, wherein said locking member comprises a slide which slides in said housing and has a handle projecting out of said housing.

3. A control for a protective mask according to claim 2, wherein said housing has a slot through which said handle of said slide extends out of said outer chamber, and a check spring disposed between the end of said handle and said housing ensuring a smooth displacement of said slide.

4. A control for a protective mask according to claim 1, wherein said control diaphragm includes an annular collar portion on the side adjacent said outer chamber, said housing having a stop formed thereon in a position adjacent the exterior of said collar portion and inside said outer chamber, said locking member having a locking nose in alignment with said stop whereby said collar portion is held between said locking nose and said stop.

5. A control for a protective mask according to claim 1, wherein said control diaphragm has an outstanding collar portion on the side adjacent said outer chamber, said locking member including a slide having one end engageable against locking projection of said pressure lever and an opposite end having a locking nose, a stop defined on the interior of said housing in said outer chamber, a slot defined in the exterior of said housing, said locking member slide having a handle portion projecting out through said slot to permit movement of said slide, said slide being positionable so as to bear against said locking projection to lift said arm portion off said control diaphragm and to move said locking nose to cause the collar to bear against said stop and be held in position in which said control lever permits a valve to close.

* * * * *